US005326039A

United States Patent [19]

Tanae et al.

[11] Patent Number: 5,326,039

[45] Date of Patent: Jul. 5, 1994

[54] AUTOMATIC BOBBIN CHANGING APPARATUS FOR A WINDING MACHINE

[75] Inventors: Fumio Tanae, Iyo; Shunzo Naito, Matsuyama, both of Japan

[73] Assignee: Teijin Seiki Co., Ltd., Osaka, Japan

[21] Appl. No.: 22,868

[22] Filed: Mar. 1, 1993

Related U.S. Application Data

[63] Continuation of Ser. No. 751,783, Aug. 29, 1991, abandoned.

[30] Foreign Application Priority Data

Aug. 31, 1990 [JP] Japan ..... 2-232015

[51] Int. Cl.[5] ..... B65H 67/04

[52] U.S. Cl. ..... 242/35.5 A

[58] Field of Search ..... 242/35.5 A, 35.5 R, 242/36, 18 A, 35.6 R

[56] References Cited

U.S. PATENT DOCUMENTS

| | | | |
|---|---|---|---|
| 3,682,403 | 8/1972 | Willis | 242/18 A |
| 3,741,490 | 6/1973 | Venot | 242/18 A |
| 3,940,077 | 2/1976 | Ohashi | 242/35.5 A |
| 4,079,898 | 3/1978 | Murakami et al. | 242/35.5 A |
| 4,555,068 | 11/1985 | Kamp | 242/36 |
| 4,564,123 | 1/1986 | Kamp | 221/11 |
| 4,591,105 | 5/1986 | Niederer | 242/18 A |
| 4,615,493 | 10/1986 | Teranishi et al. | 242/35.5 A |
| 4,805,846 | 2/1989 | Ueda et al. | 242/36 |
| 4,844,358 | 7/1989 | Kamp | 242/35.5 R |
| 4,984,749 | 1/1991 | Matsui et al. | 242/35.5 A |

FOREIGN PATENT DOCUMENTS

| | | |
|---|---|---|
| 3308454 | 9/1984 | Fed. Rep. of Germany . |
| 3624904 | 1/1988 | Fed. Rep. of Germany . |
| 48-19571 | 6/1973 | Japan . |
| 49421 | 1/1974 | Japan . |
| 51-30173 | 8/1976 | Japan . |
| 57-117464 | 7/1982 | Japan . |
| 58-42106 | 9/1983 | Japan . |
| 24504 | 1/1990 | Japan . |
| 663400 | 12/1987 | Switzerland . |
| 2039552 | 8/1980 | United Kingdom . |

*Primary Examiner*—Stanley N. Gilreath

*Attorney, Agent, or Firm*—Rothwell, Figg, Ernst & Kurz

[57] ABSTRACT

In an automatic bobbin changing apparatus of a winding machine having a plurality of work stations disposed along the lengthwise direction of a machine frame, each winding portion of work station is provided with: a yarn treating device including a yarn sucking device (21), a yarn lifting guide (22), a yarn cutting device (24), a yarn gathering arm (61) and yarn threading arm (63) a cradle turning device including a cradle (13) and a cradle turning motor (31); an empty bobbin donning device including an empty bobbin arm (51); and a package receiver (83), and disposed in the winding machine is a control member for operating the yarn treating device, the cradle turning device, the empty bobbin donning device and the package receiver when at least one of packages at the winding portions reaches a state where it is to be changed.

7 Claims, 18 Drawing Sheets

AUTOMATIC BOBBIN CHANGING APPARATUS FOR A WINDING MACHINE

This is a continuation of application Ser. No. 07/751,783, filed Aug. 29, 1991, now abandoned.

BACKGROUND OF THE INVENTION

1. Field of the Invention

The present invention relates to an apparatus for automatically changing bobbins, i.e., dolling a package and donning an empty bobbin, at a winding machine having a plurality of work stations disposed along the lengthwise direction of a machine frame.

In machines for winding a yarn, such as a draw texturing machine (DTY) , a draw twister (DT machine), a twisting machine, a double twister, a rewinding machine, a yarn winding machine, a film winding machine, or a glass fiber winding machine, a plurality of work stations are disposed along the lengthwise direction of a machine frame.

When a package is wound in such a winding machine, after the full wound package is doffed, an empty bobbin is donned, and the winding operation is continued.

Winding machines are roughly classified into two types. In a first type, the work station has a vertical spindle and a bobbin for winding a yarn is vertically supported by the vertical spindle. In the other type, a bobbin for winding a yarn is almost horizontally supported by a cradle.

Although the present invention is applicable to both types, it is preferably an apparatus for changing bobbins, i.e., doffing a full package and donning an empty bobbin, in a winding machine wherein a bobbin Sot winding a yarn is almost horizontally supported by a cradle.

2. Description of the Related Art

Conventional apparatus for doffing full packages and donning empty bobbins are roughly classified into two types:

(1) a so called simultaneous type doffer which is installed on a machine frame and which simultaneously doffs all full packages from the machine frame; and (2) a so called movable type doffer wherein a truck moves along a machine frame and which sequentially doffs full packages and dons empty bobbins.

Since doffing operations are performed at all the work stations by the simultaneous doffer, small packages, which are less than the full package to be doffed, are also doffed. Further, it is very difficult to install such a simultaneous type doffer to an already installed winding machine, such as a DTY machine, which has not been prepared for the installation of doffer equipment prior to it being installed.

Contrary to this, it is said that the movable type doffer is superior to the simultaneous type doffer because of the following reasons. The movable type doffer can be introduced to an already installed winding machine. Further, the doffed full packages can be automatically stored in a peg type stand for storing packages together with a doffing operation by a movable type doffer. In addition, one movable truck is sufficient for a plurality of winding stations.

However, generally speaking, in winding machines, including draw texturing machines, although the precisions in prefabrication of each winding device are sufficiently high, the relative locational relationships between the winding devices, especially between those belonging to different work stations, are not taken into consideration. For example, if the heights from the floor on which the machine frame is installed or the distances from the working area are measured, there can be observed a large variation between the work stations.

The above-mentioned auto doffer repeats its movement and stoppage along the lengthwise direction of the machine frame and also repeats its doffing operations, which are entirely the same at all the work stations, based on the location where it stops.

As described above, a conventional winding machine per se has a large variation between its work stations, and accordingly, the locations, based on which the operations start, are not identical between the work stations. Therefore, doffing operations cannot be assured.

In order to enhance assurance of the doffing operation, when an auto doffer such as described above is intended to be used in a conventional winding machine, the floor on which the winding machine is installed is flattened first, and then base rails are disposed with high precision at the locations where the auto doffer moves. Further, the winding machine is reconstructed so that both the preciseness in the relative locational relationships between winding devices disposed along the lengthwise direction of the winding machine and the preciseness of the prefabrication of the winding devices are enhanced.

As a result, when a conventional auto doffer is intended to be used, a very large reconstruction and a lot of costs for reconstruction are required. Therefore, the conventional auto doffers have not been practically used.

Further, U.S. Pat. No. 4,615,493 proposes an improved movable type doffer, which can be referred to as a "doffing robot" by which such a large reconstruction of the floor can be neglected. However, since this doffing robot moves on base rails, it still requires a large amount of expense for installing accompanying equipments, such as base rails disposed outside the DTY machine, and accordingly, a large space for installing the accompanying equipments. Consequently, the doffing robot cannot be readily used in a plant which has not been intended to use such a doffing robot. In addition, there is a problem that setting of a doffing program for a doffing robot is somewhat complicated. Further, there is another problem that a small package, which is less than a full package due to some reason such as yarn breakage during winding operation, is doffed together with other packages because a doffing robot usually doffs all the package in a predetermined operational time.

SUMMARY OF THE INVENTION

Taking into consideration the problems inherent to the conventional apparatus, it is an object of the present invention to obviate the above-described movable type doffer and to provide an automatic bobbin changing apparatus of a winding machine which can be installed without effecting a very large reconstruction or without requiring a lot of costs for reconstruction.

Further, it is another object of the present invention to provide an automatic bobbin changing apparatus of a winding machine which does not require a large amount of expense for installing accompanying equipment, such as base rails disposed outside the DTY machine or a large space for installing the accompanying equipment and which can be installed in a conventional plan, since a movable type doffer is not used.

It is still another object of the present invention to provide an automatic bobbin changing apparatus of a winding machine, for which a control program is not complicated and which does not doff small packages since it doffs only the fully wound packages.

According to the present invention, the above-described objects are achieved by an automatic bobbin changing apparatus of a winding machine having a plurality of work stations disposed along the lengthwise direction of a machine frame, which comprises:

a yarn treating device, a cradle turning device, an empty bobbin donning device and a package receiver, which are disposed at a winding portion of each work station of the winding machine; and a control means for operating the yarn treating device, the cradle turning device, the empty bobbin donning device and the package receiver when at least one of the packages at the winding portions reaches a state where it is to be changed, which control means is disposed in the winding machine.

According to the present invention, since a yarn treating device, a cradle turning device, an empty bobbin donning device and a package receiver are disposed at a winding portion of each work station of the winding machine, a control means may operate the yarn treating device, the cradle turning device, the empty bobbin donning device and the package receiver when at least one of the packages at the winding portions reaches a state where it is to be changed. As a result, doffing operations, donning operations, and yarn treating operations may be simultaneously performed at a plurality of work stations, and consequently, supply of compressed air may be insufficient. In order to overcome such occurrence, in an embodiment of the present invention, the control means may comprise:

a central control unit to which operational conditions for the whole winding machine, such as times for completion of winding, doffing fashion, limitation for use of suction guns, etc. are inputted and which monitors operational control; and local control units, which are disposed between the central control unit and the work stations, which exchange information between the central control unit and the work stations, and which control operation of the automatic bobbin changing devices disposed at the winding portion of each work station and which transmit signals. As a result, the number of work stations which are simultaneously subjected to doffing operation is limited to a predetermined number. Thus, a limited supply of compressed air can be effectively used in the apparatus.

Further, in a cradle turning device proposed in a conventional winding machine, for example as disclosed in Japanese Patent Publication No. Sho 58-42106, a cradle is opened and closed by a cam which is secured to a machine frame. In this case, since a bobbin is located at a certain position while the cradle becomes closed during its movement, setting of timing for chucking the bobbin is very difficult, and such a setting operation is troublesome. Further, it is very difficult to maintain preferable timing conditions.

In order to obviate the problems inherent to the conventional art, as described with reference to the embodiment of the present invention, the cradle turning device may comprise:

a drive shaft for turning cradles;

a cradle turning shaft;

a power transmitting device disposed between the drive shaft and the cradle turning shaft and provided with a play mechanism; and a cam, integrally disposed with the drive shaft, for opening and closing the cradles.

If the drive shaft for turning the cradle and the cradle are always integrally connected to each other, contact pressure for winding a yarn cannot be adjusted adequately. Contrary to this, in the embodiment of the present invention, a play mechanism is disposed between the drive shaft for turning the cradle and the cradle arm so that timing for chucking a bobbin can be easily adjusted. The play mechanism can be constructed with an electro-magnetic clutch, however, taking into consideration that such an electro-magnetic clutch is not readily compacted and is expensive, a play mechanism of a mechanical type is used in the embodiment of the present invention.

Further, at a time just before a yarn is threaded onto a bobbin by means of a threading arm of the automatic bobbin changing apparatus of the present invention, the yarn, an end of which is sucked by a suction gun operated by compressed air, wraps around a yarn guide for approximately 180°, which is disposed at an end of the threading arm. In this case, tension in the yarn running towards the yarn guide may be decreased due to the contacting resistance. The yarn under such a low tension may not be caught by a slit formed on the periphery of the bobbin even though the yarn is aligned with the slit, and accordingly, the threading operation of the yarn onto the bobbin often fails.

In order to enhance the tension in the yarn running towards the guide so as to obviate failure of the threading operation, it is necessary to increase the sucking power of the sucking device such as the suction gun. In order to enhance the sucking power, the amount of the consumed compressed air increases since the pressure of the compressed air is enhanced. Especially when the yarn is thin, the sucking power of the suction gun is low, and accordingly, the tension caused by the suction of the suction gun is low. Thus, together with the resistance caused by the yarn guide, the tension in the yarn is further decreased. Thus, the failure in the threading operation is remarkable.

In view of the problems, the yarn treating device may include: a yarn threading arm for engaging a yarn which is sucked by a sucking device and for threading the yarn onto a bobbin located at a winding portion; and a yarn guide rotatably disposed at an end of the yarn threading arm.

In this threading device, since the yarn guide disposed at the end of the threading arm is rotatable, the tension in the yarn is not lowered, and when the yarn is aligned with the slit formed on the bobbin, the yarn is surely engaged with the slit. Thus, threading operation can be done assuredly without causing threading failure. Further, since the tension in the yarn running to the yarn guide is sufficiently high, the sucking power of the sucking device is not required to be increased. Accordingly, the amount of the consumed compressed air does not increase. In addition, according to the embodiment of the present invention, thin yarn can be successfully threaded onto a bobbin.

Further, the position of the slit formed on the bobbin may be varied due to the bobbin chucking condition by bobbin holders or the preciseness of the slit. In order to prepare such cases, as will be described with reference to an embodiment of the present invention, the threading arm may be movable in a direction of an axis of the bobbin. Due to this construction, the yarn can be surely located at a position corresponding to the slit even if the position of the slit formed on the bobbin is varied in an axial direction.

In order to allow the threading arm to move in a direction of an axis of the bobbin, the threading arm may be made of an elastic member. Further, it is preferred that a secured guide provided with an inclined groove is disposed between the end of the threading arm and the center of its rotation so that the guide disposed at the end of the threading arm is moved in parallel with the axis due to the engagement of the threading arm with the inclined groove. In this case, it is preferred that the threading arm engages with the inclined groove just before it engages with the bobbin. When the threading arm is made of an elastic member as described above, the position of the yarn guide returns to a constant position at the original stage wherein the yarn is engaged with the yarn guide of the threading arm.

BRIEF DESCRIPTION OF THE DRAWINGS

The present invention will now be described in detail with reference to the accompanying drawings which show a preferable embodiment of the present invention, wherein:

FIG. 7(*b*) is a continuation of the flow chart shown in FIG. 7(*a*).

PREFERRED EMBODIMENT

In a winding machine to which the present invention is applied, a plurality of work stations are disposed along the lengthwise direction of a machine frame, and each work station is provided with a plurality of winding portions vertically overlaid.

Figure 1:
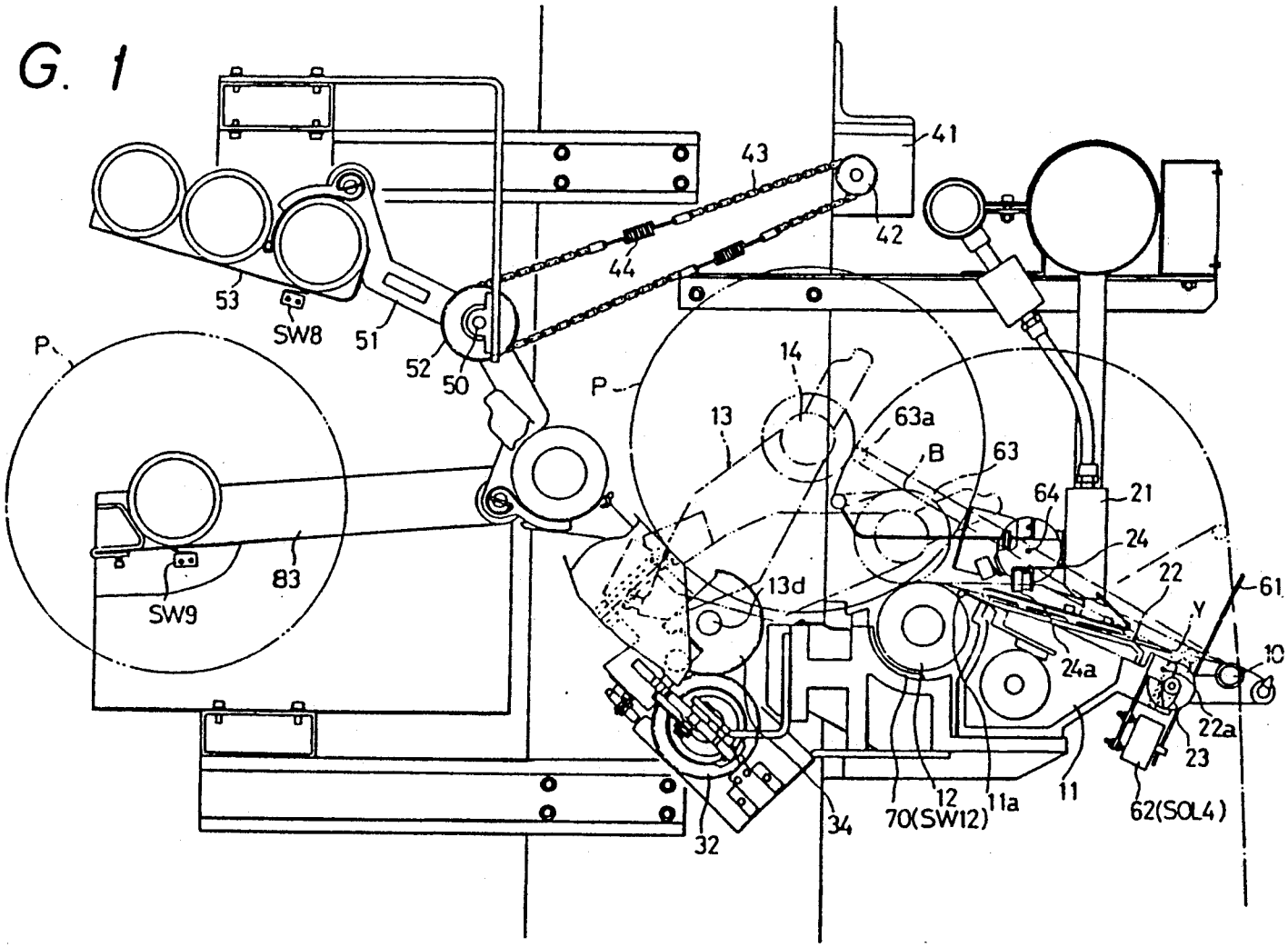
FIG. 1 is a side view of an essential portion of an embodiment of an automatic bobbin changing apparatus of a winding machine according to the present invention.

FIG. 1 is a side view showing one of the winding portions. In FIG. 1, a yarn is processed in a draw texturing machine (DTY machine), and then after it is turned in direction at a turning guide 10, it is traversed to and fro in a direction perpendicular to a sheet on which FIG. 1 is drawn by a traverse guide 11*a* of a traverse device 11.

Figure 3:
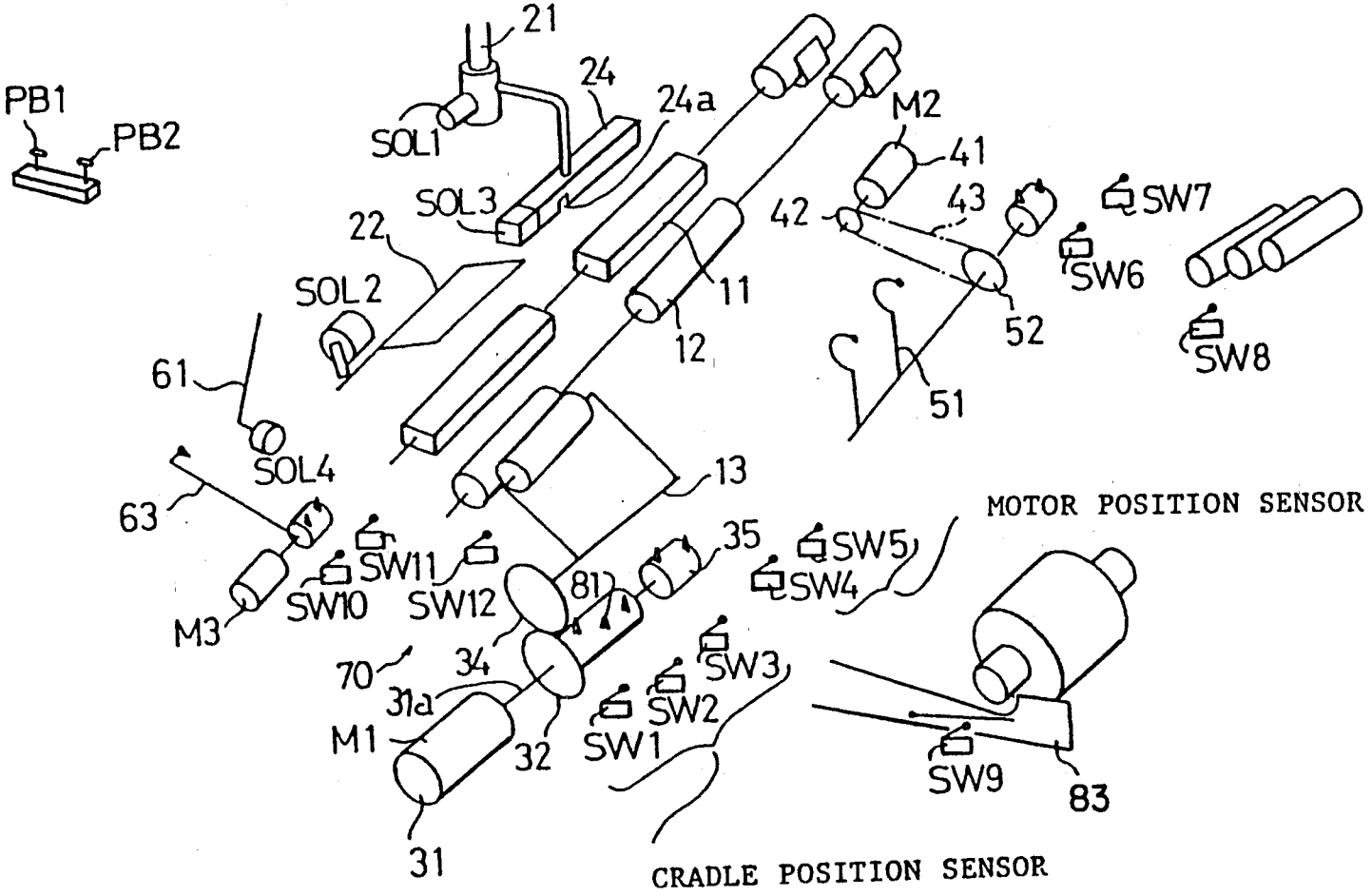
FIG. 3 is a schematic perspective view of a control means of the device illustrated in FIG. 1.
Figure 15:
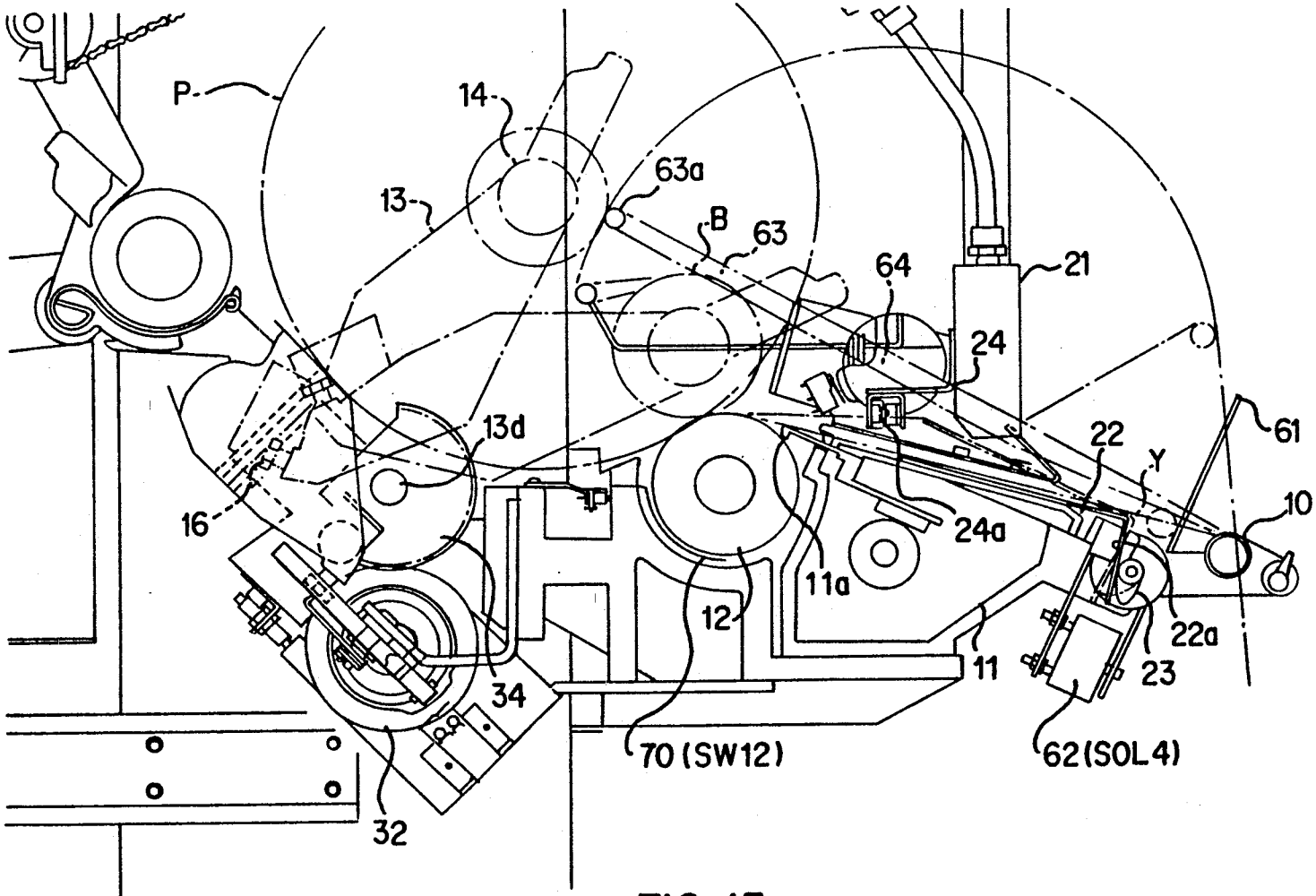
FIG. 15 is an enlarged view of the present invention as shown in the lower right portion of FIG. 1.

As seen in FIG. 15, which is an enlarged view of the lower right portion of FIG. 1, the yarn Y traversed by the traverse guide 11*a* reaches a friction roller 12 which is rotatably supported, land then it is wound onto a bobbin B, which is frictionally rotated by the friction roller 12, or onto a package of yarn layer P formed on the bobbin B. The bobbin B is rotatably supported by a cradle 13. A sensor 70, which is designated as SW12 in FIG. 3, is disposed near the friction roller 12 to detect entanglement of the yarn around the friction roller 12.

Figure 2:
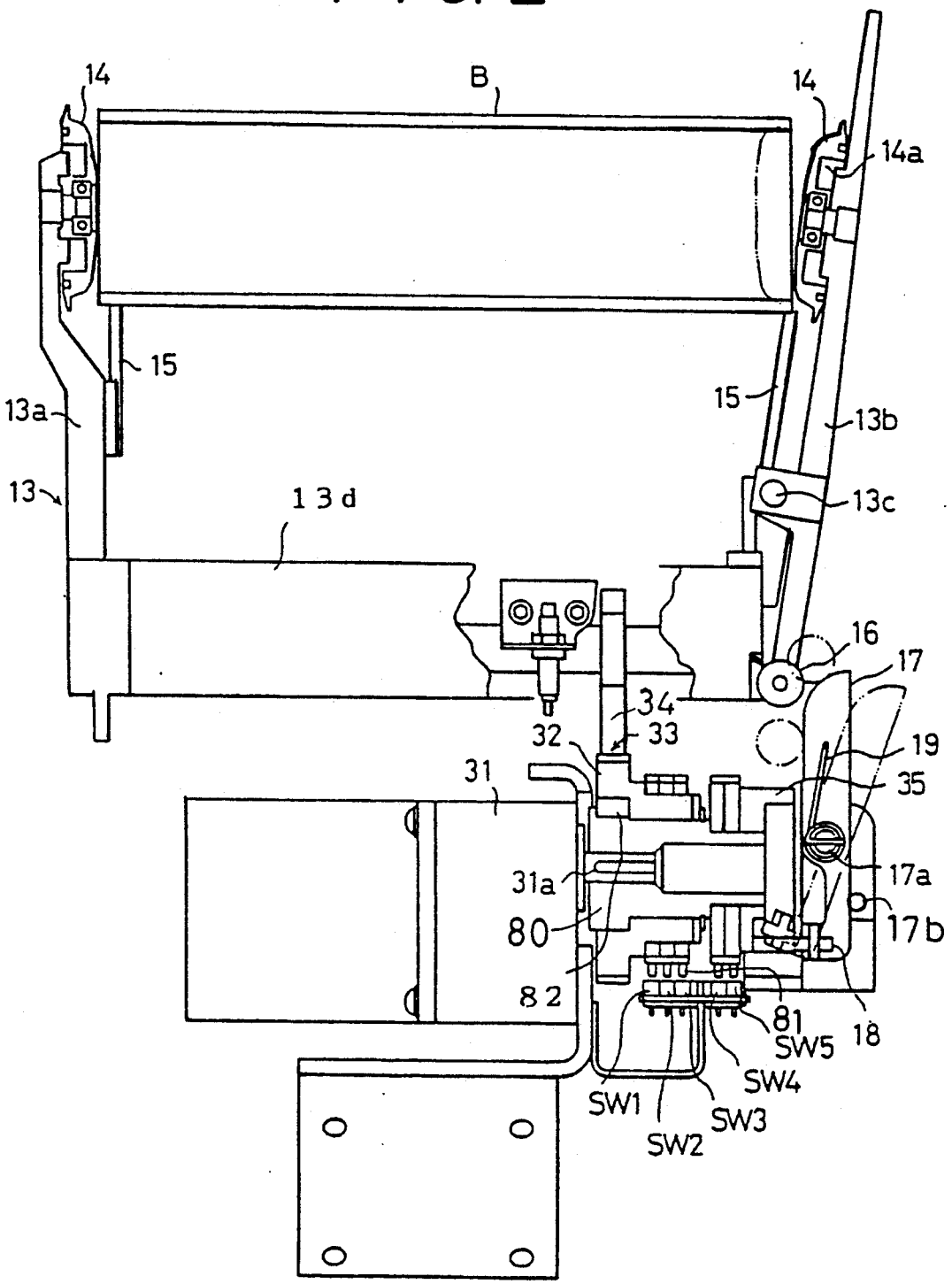
FIG. 2 is an elevation of a cradle illustrated in FIG. 1 and is partially cross sectioned.
Figure 16:
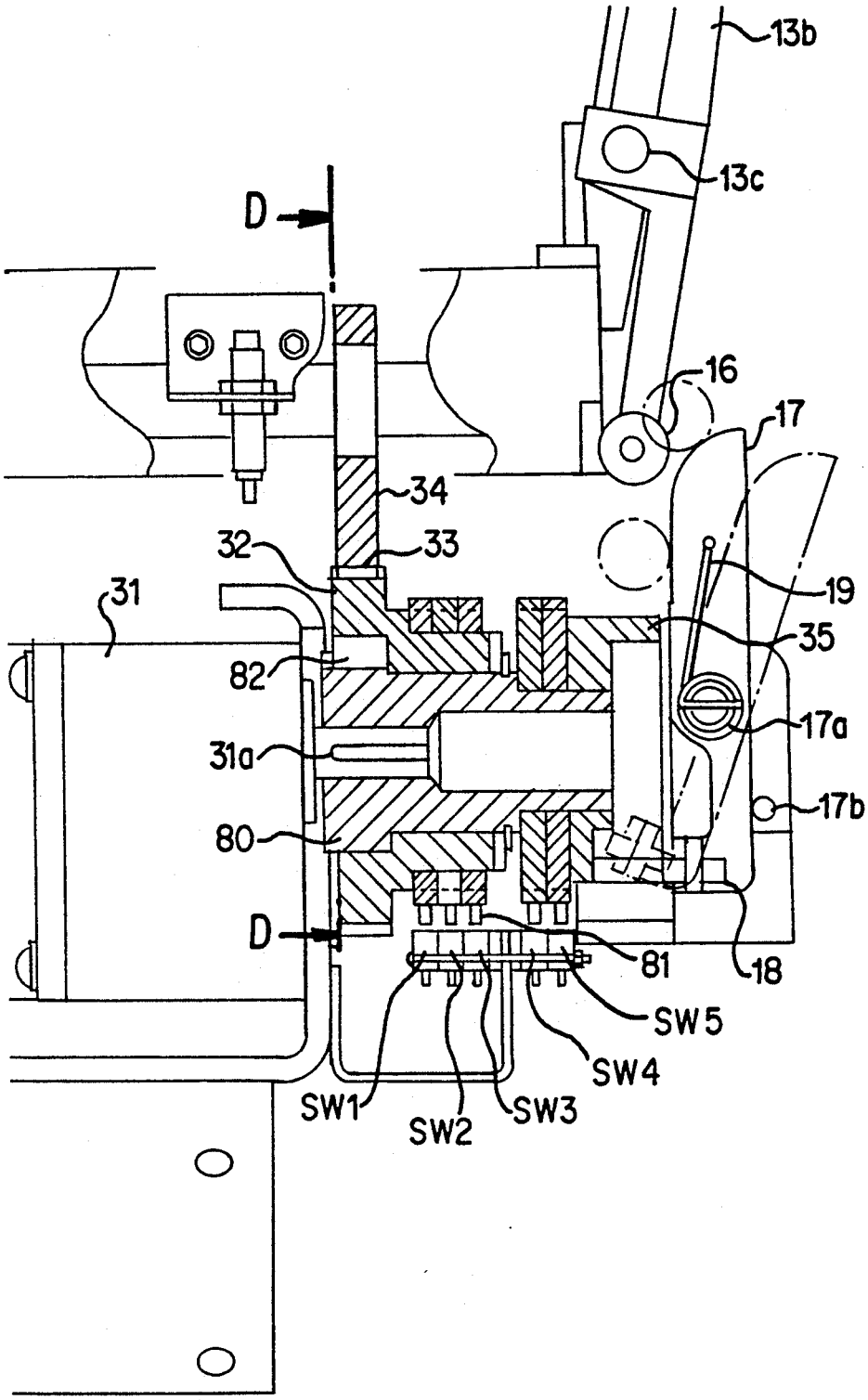
FIG. 16 is an enlarged view of the present invention as shown in the lower right portion of FIG. 2 with hatching lines added to indicate the sectioned portion.

The cradle 13 is turnable about a cradle turning shaft 13*d*, and as illustrated in FIGS. 2 and 16, it includes a rigid cradle arm 13*a*, which is integrally secured to the cradle turning shaft 13*d*, and a hinged cradle arm 13*b*, which is swingable about a pivot 13*c* disposed on the cradle turning shaft 13*d*. Further, the cradle 13 is provided with bobbin holders 14 and a brake mechanism (not shown), which is installed in the rigid cradle arm 13*a* and the hinged cradle arm 13*b* and which operates to brake a bobbin when the cradle 13 exceeds a yarn winding region. A spring (not shown) is disposed in the hinged cradle arm 13*b* so as to always chuck the bobbin B.

The hinged cradle arm 13*b* has a cam follower 16 rotatably mounted at a lower end thereof, and the cam follower 16 engages with a cradle releasing cam 17 which is supported turnably about a pin 17*a* which is fixed to the bracket disposed on a machine frame. A torsion coil spring 19 is disposed between the pin 17*a* and the cradle releasing cam 17 so that the lower portion of the releasing cam 17 is always urged to an eccentric pin 17*b* by means of the urging force of the torsion coil spring 19. The eccentric pin 17*b* serves as a stop so that the upper portion of the releasing cam 17 does not excessively move to the left in FIG. 2.

Figure 17:
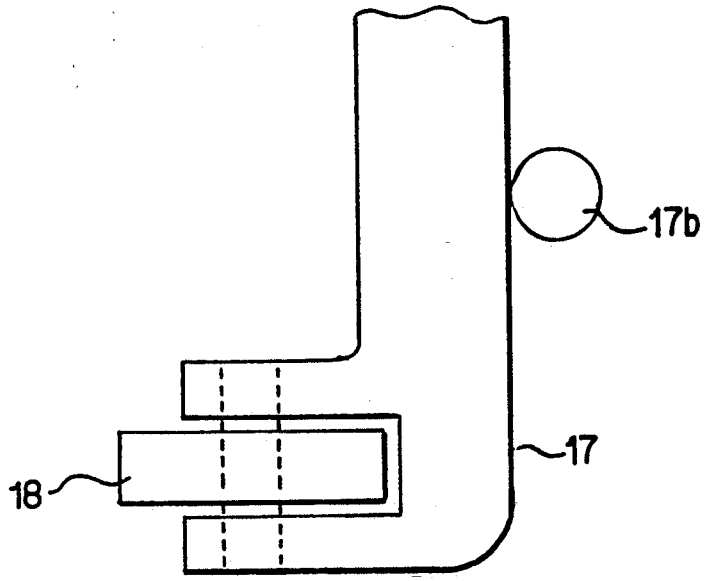
FIG. 17 is an enlarged view of the lower portion of the releasing cam shown in FIGS. 2 and 16.

As seen in FIGS. 2, 16 and 17, the releasing cam 17 has a cam follower 18 rotatably mounted at a lower end thereof. Thus, the cam follower 18 mounted on the releasing cam 17 comes in contact with a releasing cam 35 only when the cam follower 16, mounted on the hinged cradle arm 13*b*, engages with the releasing cam 17 so that the cam surface of the releasing cam 17 receives a rightward force.

The urging force of the spring (not shown) disposed in the cradle 13 for chucking the bobbin B is larger than that of the torsion coil spring 19. Further, the releasing cam 35 has a recessed portion about a motor spindle 31*a* so that the cradle 13 chucks the bobbin B when the cam follower 18 of the releasing cam 17 drops into the recessed portion of the releasing cam 35 as illustrated by a dot and dash line in FIGS. 2 and 16.

Referring to FIGS. 1 and 15 again, a yarn sucking device 21 is disposed above the traverse device 11 and is actuated by an electro-magnetic solenoid which is designated by SOL 1 in FIG. 3, and the lower end of the sucking device 21 opens near the yarn path extending from the turning guide 10 to the friction roller 12.

Figure 20:
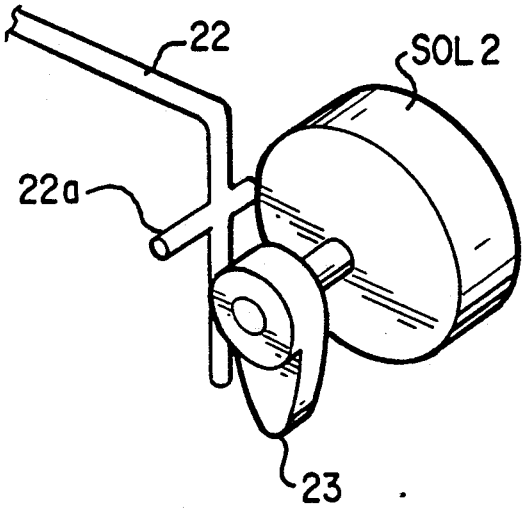
FIG. 20 is a perspective view of a cam shown in FIGS. 1 and 15.

A yarn lifting guide 22 having an L shaped cross section is disposed along the upper surface of the traverse device 11 and is supported turnably about a pivot 22*a*. See FIG. 20. The yarn lifting guide 22 is turned about the pivot 22*a* by an electro-magnetic solenoid, which is designated by SOL 2 in FIG. 3, and a cam 23 disposed on the machine frame.

A yarn cutting device 24 is disposed above the yarn lifting guide 22, and it has a yarn engaging groove 24*a* (see FIG. 3) at an appropriate position. The yarn Y engaged in the groove 24*a* is cut by a cutter (not shown) of a scissors type which is actuated by an electro-magnetic solenoid (SOL 3 in FIG. 3).

Referring to FIGS. 2 and 16 again, a small motor 31 (M1 in FIG. 3) for turning the cradle 13 is disposed on the machine frame. A motor spindle 31*a* of the cradle turning motor 31 has a gear 32 mounted thereon via a play mechanism 33, and at the same time, has a cam 35 integrally secured thereto. The gear 32 engages with a gear 34 (FIG. 1) mounted on the cradle turning shaft 13*d*.

The gear 34 is disposed within the cradle turning shaft 13*d* in such a manner that its center is aligned with the axis of the rotation of the cradle turning shaft 13*d*. As described above, the cam follower 16 illustrated in FIGS. 2 and 16 engages with the releasing cam 17 at the chuck start position when the cradle is turned, and thereafter, it moves as it is in contact with the releasing cam 17 so that the hinged cradle 13*b* is released from the bobbin chucking condition. During this operation, due to the relationship between the releasing cams 17 and 35, the construction of which will be described later, the releasing cam 17 is not moved by the releasing cam 35.

Due to the above-described manner, in the case that the play mechanism 33 is not actuated when the cradle turning motor 31 is operated, the cradle 13 is turned about the cradle turning shaft 13*d* due to the gears 32 and 34, and the cam 35 is rotated together with the spindle 31*a*.

The play mechanism 33 may be constructed with a mechanical clutch or an electro-magnetic clutch. It is preferred that in the case of the actuation of the play mechanism 33 that the rotation of the motor spindle 31*a* is not transmitted to the gear 32, even when motor spindle 31*a* is rotated while only the cam 35 integrally secured to the spindle 31*a* is rotated. The play mechanism 33 applied in the present embodiment has a construction which will be described in detail.

Figure 18:
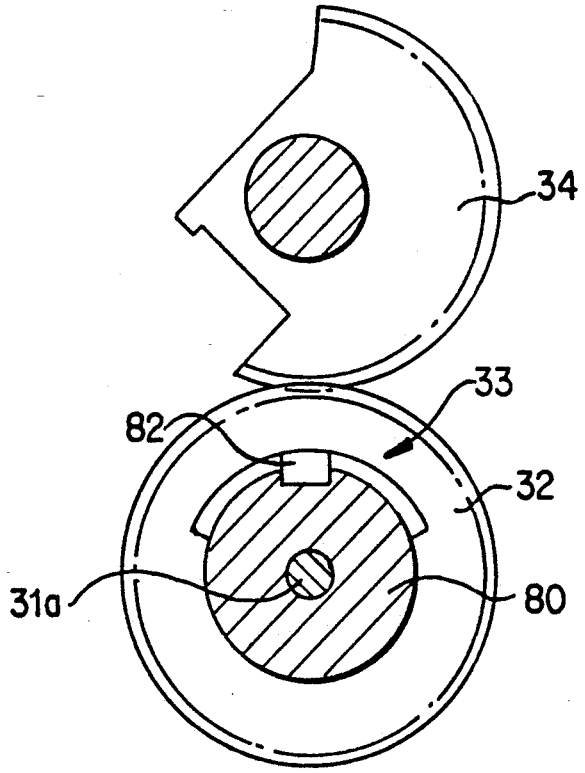
FIG. 18 is an enlarged view of the play mechanism shown in FIGS. 2 and 16 looking in the direction of arrows D—D in FIG. 16.

More specifically, FIGS. 16 and 18, the motor spindle 31*a* has a gear holder 80 secured thereto, and the releasing cam 35 is secured to the gear holder 80. When the cam 35 is rotated, the cradle releasing arm 17 which is engaged with the cam 35 is swung about the pin 17*a*. Further, the gear holder 80 has a key groove, which is formed with a key width of usual key tolerance, and a key 82 is secured to the key groove. Contrary to this, gear 32 which engages with the gear holder 80 has a key groove formed therein, the key width of which is wider than the width of the key 82 by a distance which corresponds to the free rotational distance required by the gear holder 80. Thus, the gear 32 is partially, i.e., for the distance corresponding to the above-described free rotational zone, not transmitted the rotational power though the gear holder 80 is rotated. See FIG. 18.

Figure 19:
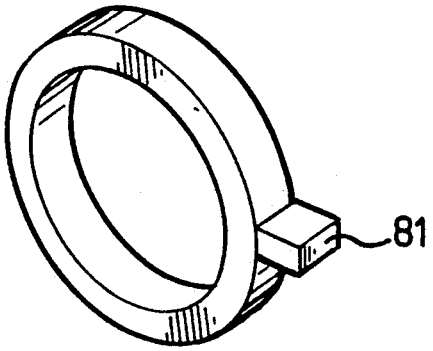
FIG. 19 is a perspective view of one of the knockers shown in FIGS. 2 and 16.

The motor spindle 31*a* has a plurality of knockers 81 as illustrated in FIGS. 2, 3 and 19, which actuate sensors for cradle positions including SW1 for detecting the winding position, SW2 for detecting the braking position, SW3 for detecting the package exhaust position, and sensors for motor positions including SW4 for detecting intermediate position of the motor and SW5 for detecting the backward position of the motor, respectively. The above-described sensors may be constructed with limit switches.

In FIG. 1, a bobbin receiver 83 is so disposed that it projects outwardly from a position where the cradle 13 is tuned opposite to the friction roller 12, and it guides fully wound packages doffed from the cradle 13. SW9 in FIG. 3 designates a sensor for detecting whether or not a package exists.

As illustrated in FIG. 1, a small motor 41 for driving an empty bobbin donning device is disposed on the machine frame above the cradle 13, and it has a sprocket 42 attached to a motor spindle thereof. An empty bobbin arm 51 is supported on the machine frame so that it is rotatable about a pivot 50, and it has a sprocket 52 integrally secured thereto. Chain 43 is engaged around the sprockets 42 and 52 so that the empty bobbin arm 51 is turned by the small motor 41 from a position corresponding to an empty bobbin supply rail 53 until it abuts with a mechanical stop (not shown). The chain 43 has springs 44 at intermediated portions thereof so that shock caused by the abutment of the empty bobbin arm 51 against the stop is damped.

In FIG. 3, SW6 designates a sensor for detecting a position for taking up a bobbin, SW7 designates a sensor for detecting a position for supplying a bobbin, and SW9 designates a sensor for detecting whether or not an empty bobbin exists on the empty bobbin supply rail 53.

Figure 21:
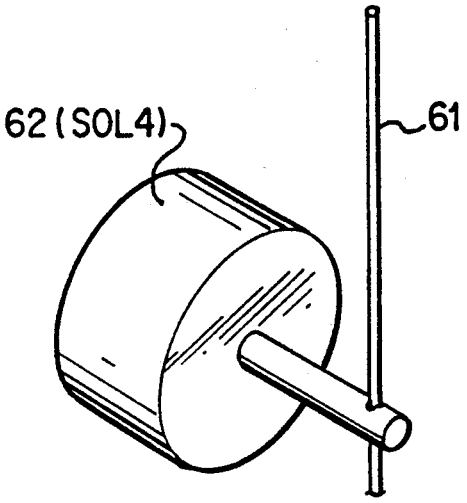
FIG. 21 is a perspective view of the gathering arm shown in FIGS. 1 and 15.

As seen in FIGS. 1 and 21, a yarn gathering arm 61 is disposed between the traverse device 11 and the turning guide 10 in such a manner that it is swung by an electro-magnetic solenoid 62, which is designated by SOL 4 in FIG. 3, in a plane perpendicular to the yarn path. Accordingly, the gathering arm 61 moves the yarn Y, which has extended from the yarn turning guide 10 to the suction device 21, to a position where a threading arm 63 can readily engage with the yarn Y.

Figure 11:
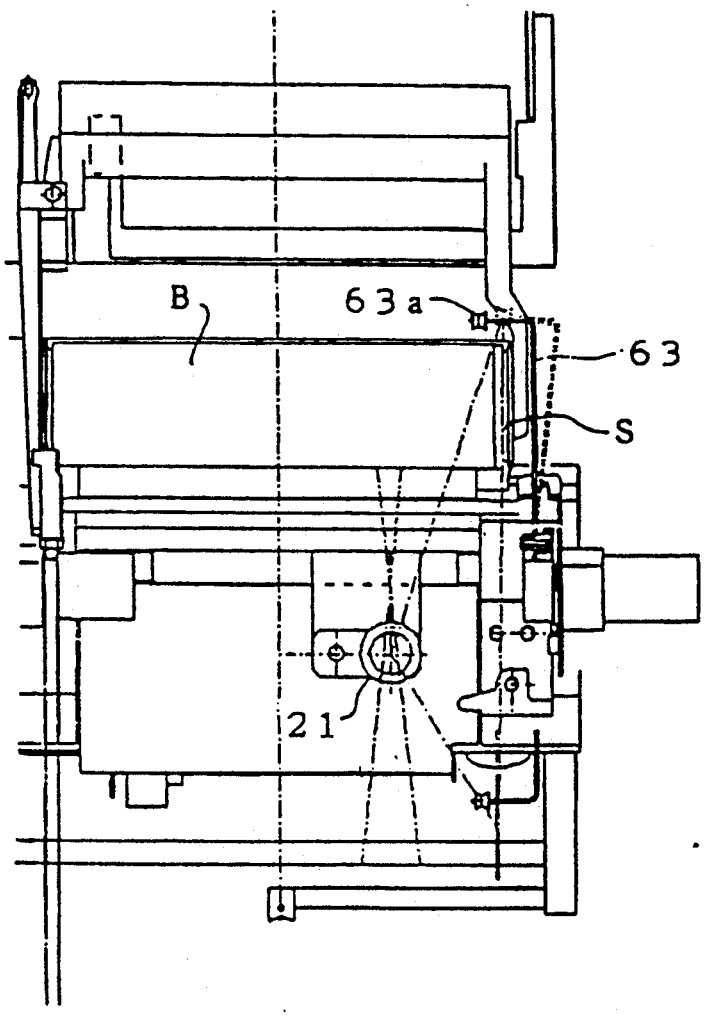
FIG. 11 is an elevation of an essential portion of the embodiment of the threading device according to the present invention.
Figure 12:
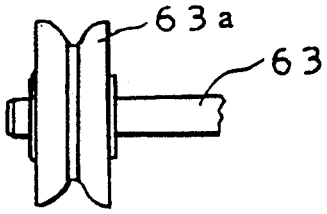
FIG. 12 is an enlarged elevation of an essential portion of FIG. 11.

The threading arm 63 illustrated in FIG. 1 is turned by the threading motor 64 which is designated by M3 in FIG. 3 at a position above the traverse device 11, and it threads the yarn Y, which has been gathered by the yarn gathering arm 61 to an appropriate position, onto an empty bobbin B. The threading arm 63 is made of an elastic member, such as a piano wire, formed in an L shape as illustrated in FIG. 11, and it has a yarn guide 63*a* rotatably mounted at an end thereof. The yarn guide 63*a* has a V shaped groove formed at the periphery thereof as illustrated in FIG. 12 so that it can maintain the running position of the yarn Y.

A guide plate (not shown) provided with an inclined groove is securely disposed at a position between the end of the threading arm 63 and the threading motor 64 so that when the threading arm engages with the inclined groove, the yarn guide 63*a* disposed at the end of the threading arm 63 can be moved in parallel with the axis of the bobbin B. The relationships between the guide plate and the threading arm 63 are so selected that the threading arm engages with the inclined groove just before the yarn Y contacts with the bobbin B.

Since the threading arm 63 is made of an elastic member as described above, its end can move in a direction of the axis of the bobbin B, and accordingly, the yarn Y can surely be positioned to a position corresponding to a slit S formed on the bobbin B even when the position of the slit S may be varied due to the bobbin chucking condition by the bobbin holders 14 or the preciseness of the slit S. When the threading arm 63 is made of an elastic member as described above, the position of the yarn guide returns to a certain position at the original stage wherein the yarn is engaged with the yarn guide of the threading arm.

In FIG. 3, SW10 designates a sensor for detecting the front end of the threading arm 63, and SW11 designates a sensor for detecting the rear end of the threading arm 63.

In this embodiment, the yarn sucking device 21, the yarn lifting guide 22, the yarn cutting device 24, the yarn gathering arm 61 and the yarn threading arm 63, which have been described above, constitute a yarn treating device of the present invention.

Figure 13:
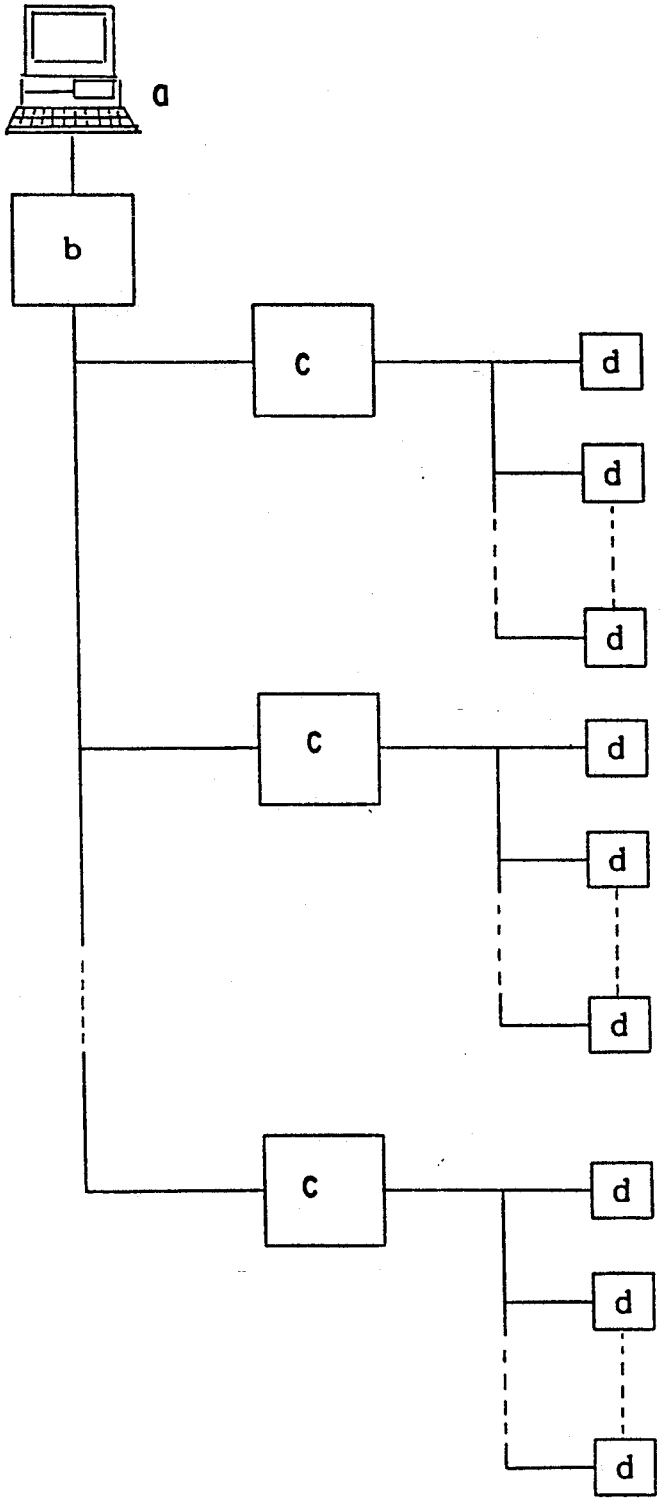
FIG. 13 is a diagram showing the construction-of an embodiment of a control means of the present invention.

Further, in this embodiment, as illustrated in FIG. 13, the control means comprises a central control unit (CPU) b installed in a host computer a and local control units c. The central control unit b receives input relating to the operational conditions of the whole winding machine, such as times when full bobbins are wound, doffing fashion, and limitations regarding the use of the suction gun and performs monitoring of the operational conditions. The local control units c are disposed between the central control unit b and the work stations d, and they transmit signals from the central control unit b to the work stations d and vice versa so as to operate the devices for automatic bobbin changing disposed at the winding portions of the work stations d. The central control unit b sequentially scans the work stations d and the local control units c, and transmits signals to and receives signals from the local control units c. Further, the central control unit b limits the number of bobbins which are doffed at the same time so as to operate the changing device effectively under the limited supply of the compressed air.

The yarn treating device, the cradle turning device, the empty bobbin donning device and the package receiver, which are disposed at the winding portion of each work station d, are controlled by the corresponding local control unit c under the control of the central control unit b and perform the operations which will be described below. PB1 and PB2 in FIG. 3 designate manually operated switches for resetting and for stopping the automatic operations, respectively.

Figure 8:
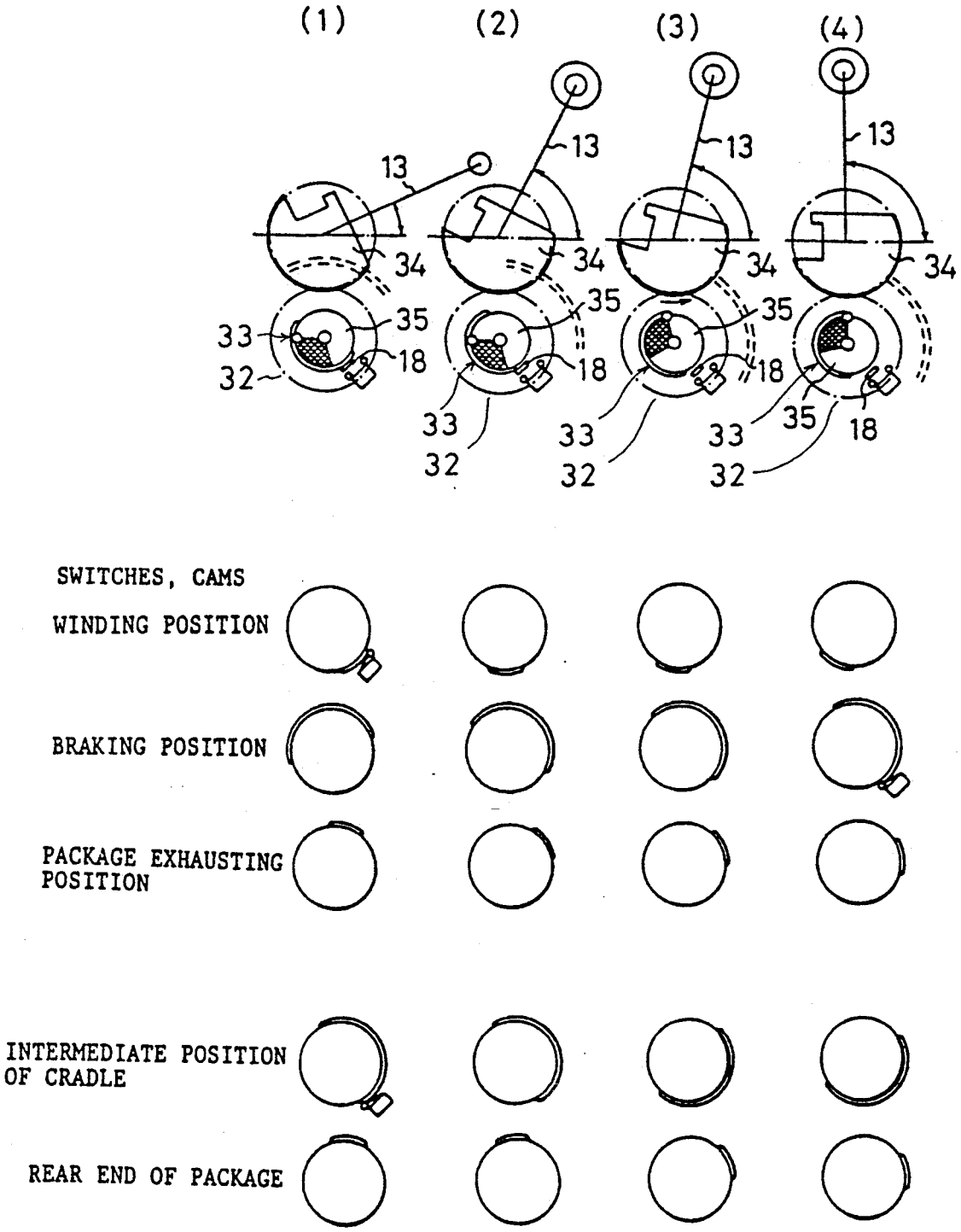
FIG. 8 is a diagram showing operations of a threading device of the embodiment of the present invention.
Figure 9:
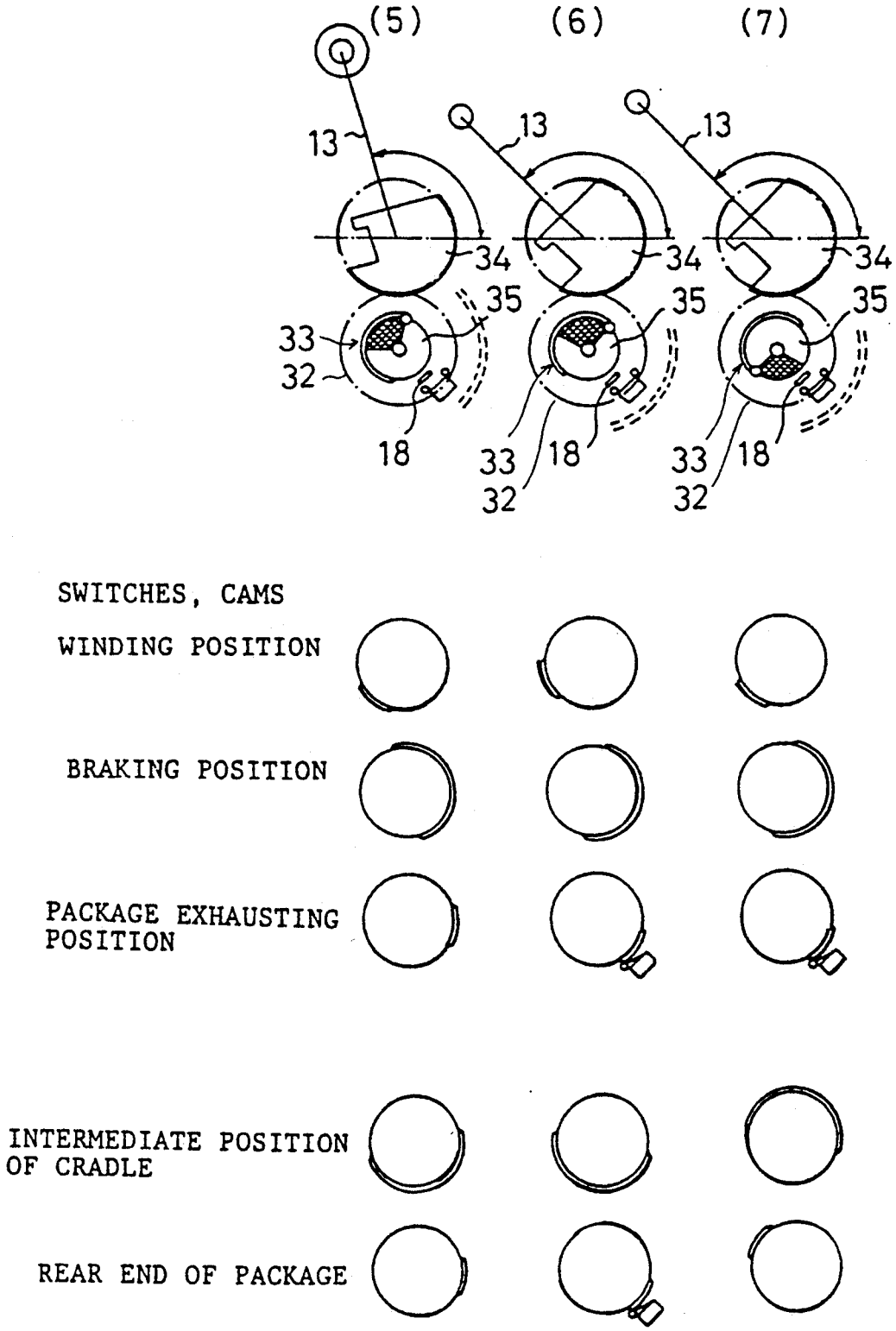
FIG. 9 is a diagram subsequent to FIG. 8 and showing operations of the threading device of the embodiment of the present invention.
Figure 10:
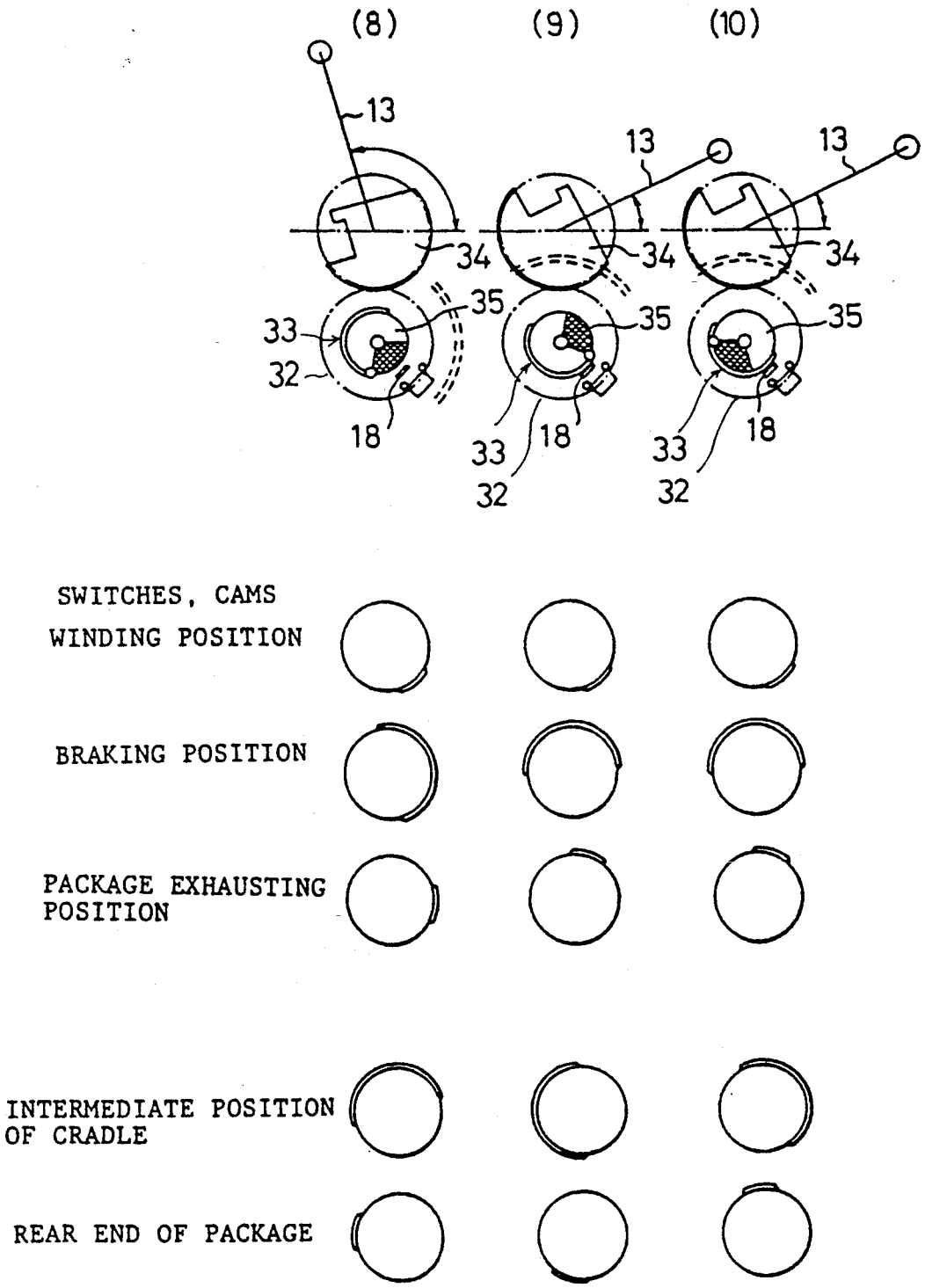
FIG. 10 is a diagram subsequent to FIG. 9 and showing operations of the threading device of the embodiment of the present invention.

The operations of the cradle turning device of the present embodiment are illustrated in FIGS. 8 to 10 in a sequential order. More specifically, in FIGS. 8 to 10, (1) to (10) sequentially show the change of the operations. The upper portion of each figure illustrates the operational conditions of the embodiment of the cradle turning device comprising the drive shaft 31*a* for turning the cradle, the cradle turning shaft 13*d*, the play mechanism 33 which is disposed between the drive shaft 31*a* and the cradle turning shaft 13*d* and which selectively transmits the power and the cam 81 integrally disposed on the drive shaft 31*a* for opening and closing the cradle.

In the upper drawings, the portions with mesh indicate the recessed portion in the releasing cam 35. Reference numeral 18 indicates the position of the cam follower of the releasing cam 17. Further, the cam follower 16 of the hinged cradle arm 13 is disposed at the lower portion of the arc designated by broken lines, though the illustration is somewhat modified from the actual operations in order to facilitate explanation.

Further, the lower drawings illustrate the operations of the switches for switching the operation of the motor 31, such as SW1 for detecting the winding position, SW2 for detecting the braking position, SW3 for detecting the package exhaust position, SW4 for detecting intermediate position of the cradle, i.e., where the key 82 is located in the free zone of the gear 32 while the cam follower 18 of the releasing cam 17 is not located in the recessed portion of the releasing cam 35, and SW5 for detecting the backward position of the cradle which is substantially the same as the package exhaust position, and the lower drawings also illustrate the operations of the cams 81 for actuating the switches.

Figure 4:
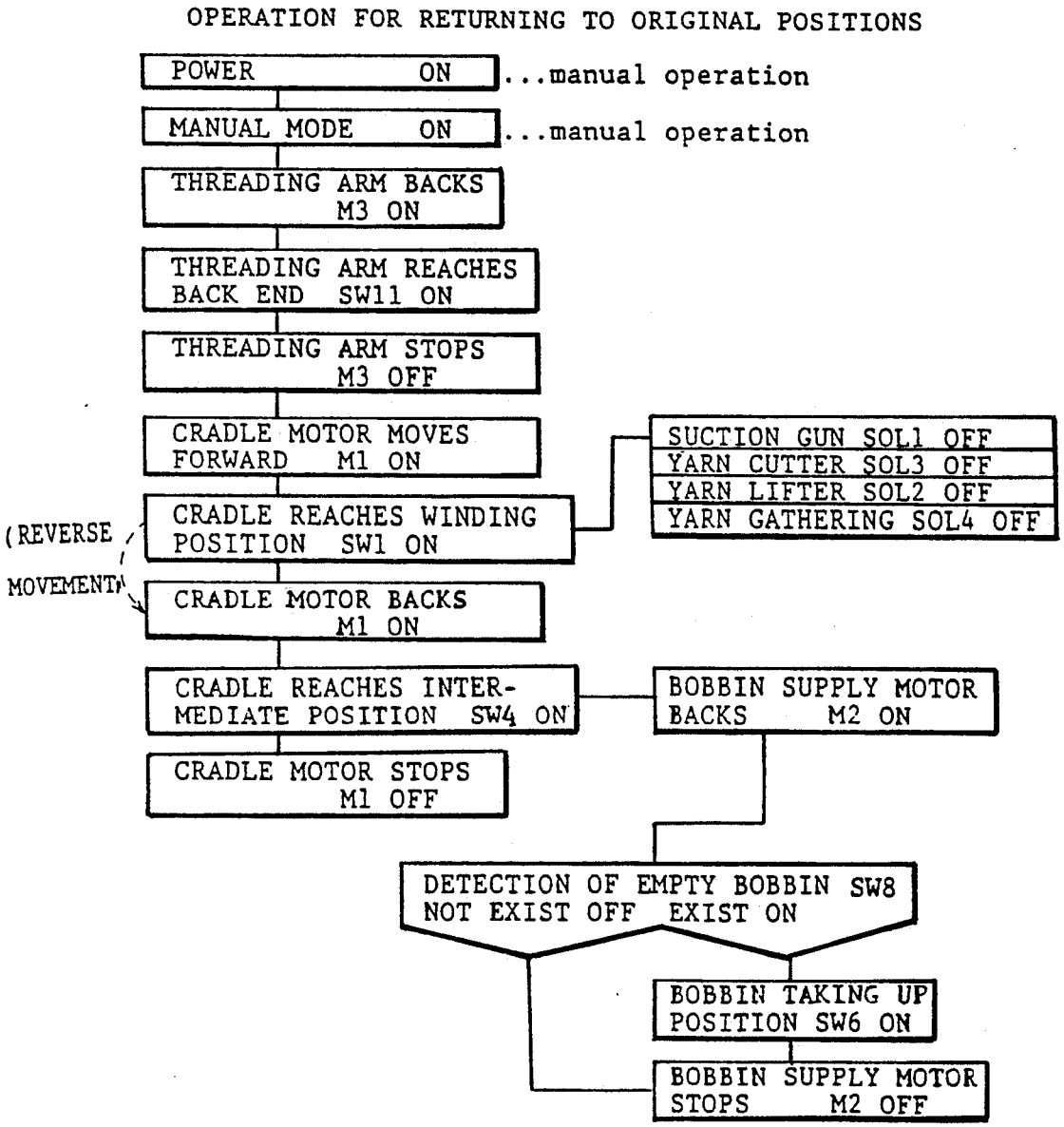
FIG. 4 is a flow chart for returning operation to the original positions.

(1) Operation for returning to the original positions:

The operation is performed in accordance with the flow chart illustrated in FIG. 4. The drawing in (1) in FIG. 8 illustrates the beginning condition for winding a yarn. In this condition, the motor 31 is stopped, and the key 82 locates in the free zone of the gear 32. In the state illustrated in (1), an operator can manually turn the cradle 13, and he also can manually open and close the hinged cradle arm 13*b* since the cam follower 18 of the releasing cam 17 is not located in the recessed portion of the releasing cam 35.

Figure 14:
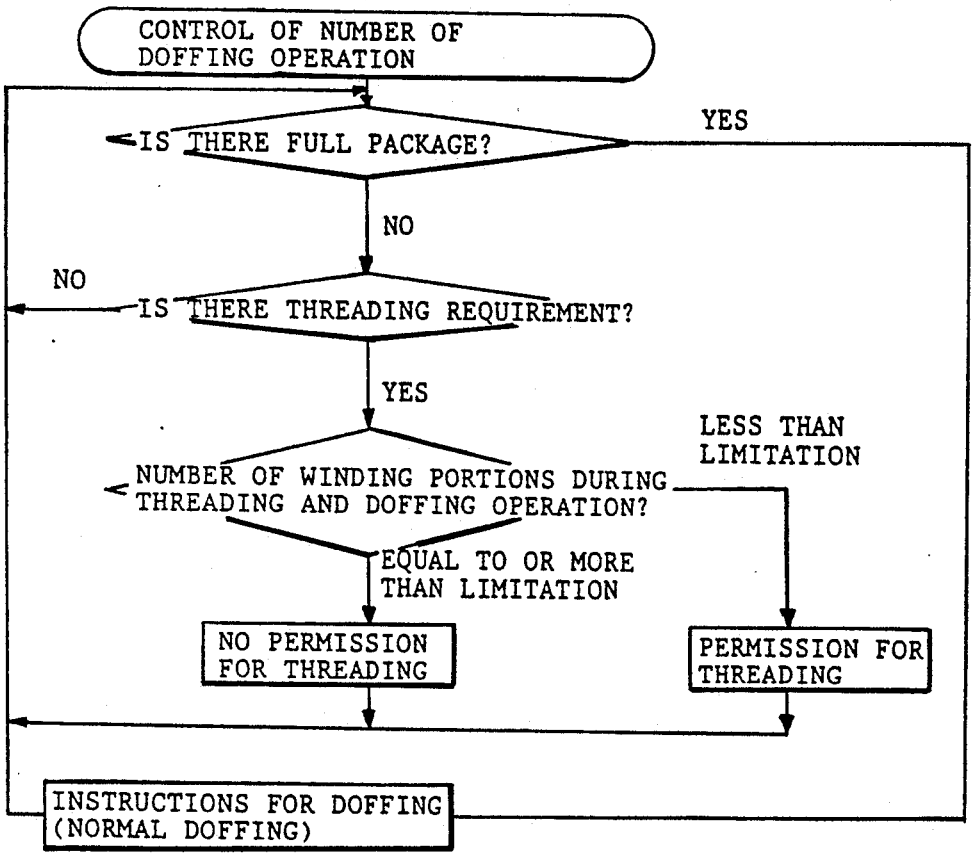
FIG. 14 is a flow chart of the doffing and threading operations.

(2) Instructions for doffing:

The draw texturing machine (DTY machine) is provided with a function for controlling the work stations. More specifically, the DTY machine is provided with parts for monitoring the yarn speeds and the parts for monitoring the existence of the yarns, and based on the monitored data, the amounts of yarns which are being wound in respective winding portions of the work stations can be calculated by the central control unit (CPU) b. As illustrated in FIG. 14, it is checked whether or not a fully wound bobbin exists. If there is a winding portion to which a full package signal is transmitted from the winding amount controlling part, the doffing operation of said working station d is started through the corresponding local control unit c in accordance with the following steps. Contrary to this, if there is no full package signal, then, it is checked whether or not there is a requirement for threading. If there is no winding portions with requirement for threading, then, it is checked again whether or not another full package signal is transmitted on the next work station.

The doffing operation is performed in accordance with the following steps. The state illustrated in (2) in FIG. 8 illustrates the position of a fully wound package. The key 82 is still in the free zone in the gear 32.

Figure 7:
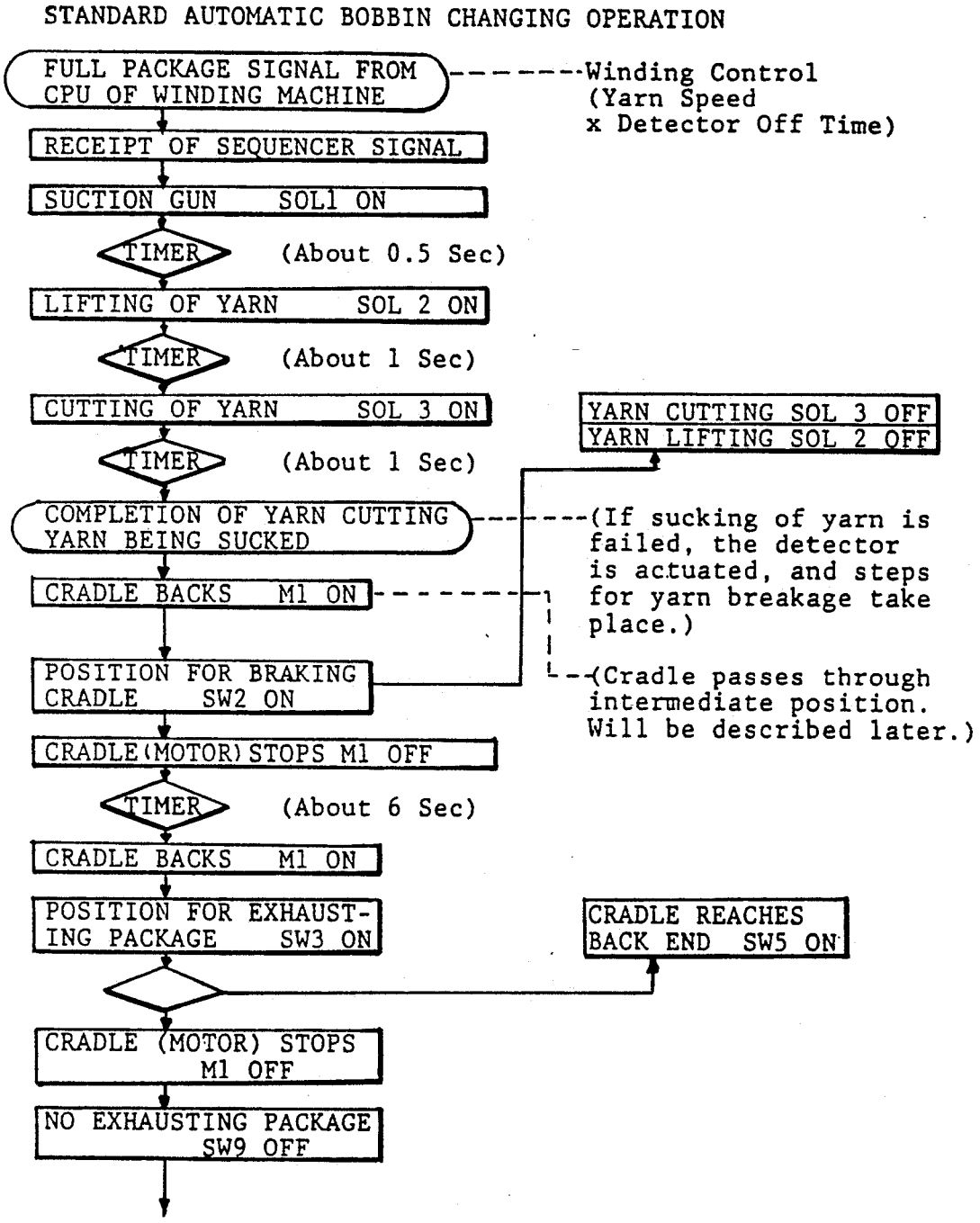
FIG. 7(*a*) is a flow chart for a standard automatic changing operation.
Figure 7:
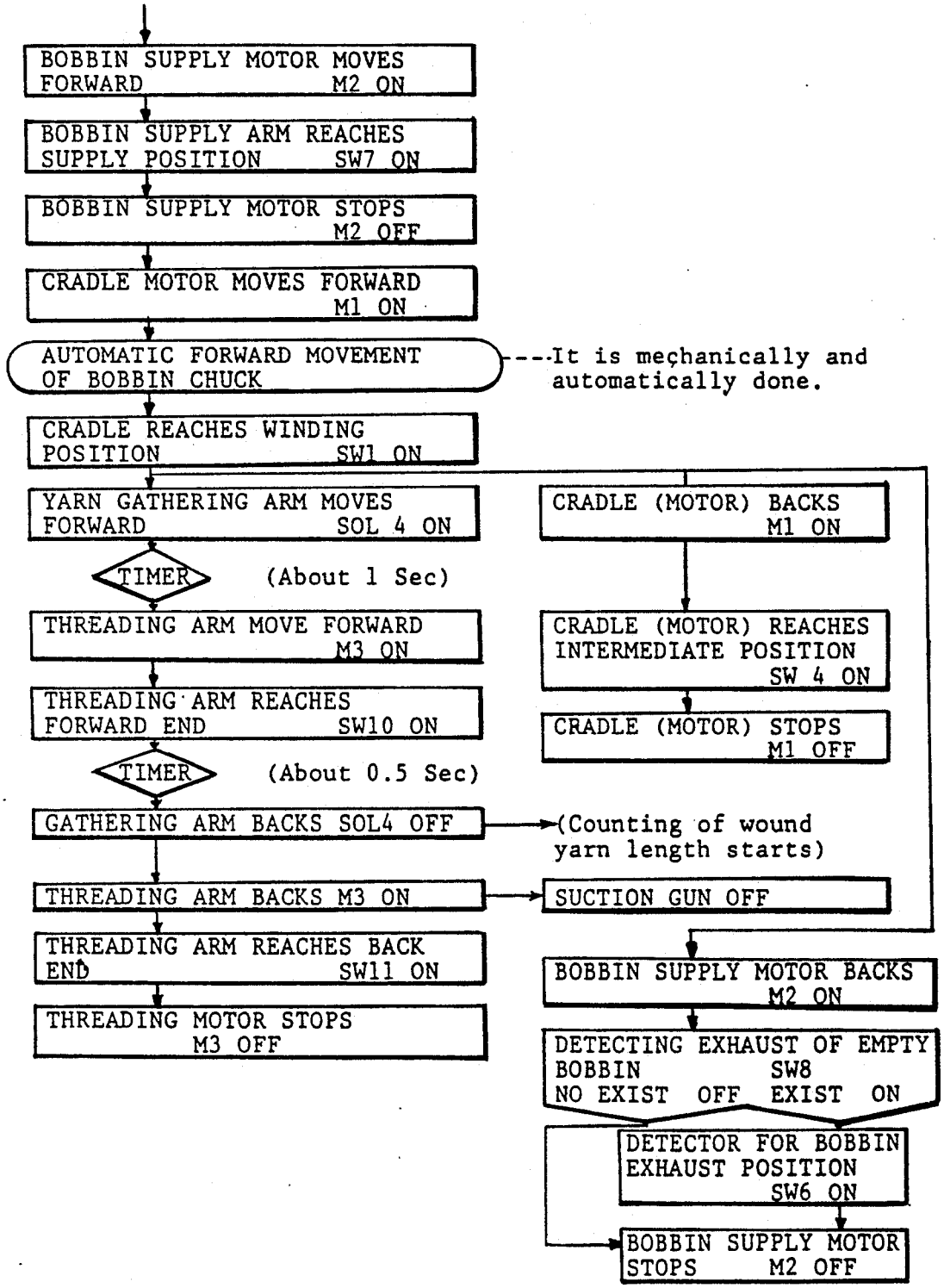

(3) Doffing operation (see FIG. 7):

a. The sucking device 21 disposed above the traverse device 11 is switched on so that it can suck a yarn.

b. The yarn Y is lifted by means of a yarn lifting guide 22 which is located between the running yarn Y and the upper surface of the traverse device 11. In this occasion, the yarn Y is engaged in the yarn engaging groove 24*a* formed on the yarn cutting device 24 as it is traversed, and then it is disengaged from the traverse guide 11*a*.

c. The yarn Y, which is engaged in the yarn engaging groove 24*a* of the yarn cutting device 24, is then cut by the yarn cutting device 24, and then the yarn Y is sucked by and flows in the sucking device 21. Thereafter, the lifting guide 22 ia returned to its original position.

The above-described steps are the yarn treatment until the yarn is sucked.

d. Then, the cradle 13 is turned in a counterclockwise direction as illustrated in FIG. 8 (3). The power for turning the cradle 13 is the small motor 31, and the gear 32 is rotated in a direction indicated by an arrow by means of the key 82 secured to the motor spindle 31*a*, and accordingly, the gear 34 attached to the cradle turning shaft 13*d* is driven, and consequently, the cradle 13 is turned. The state illustrated in FIG. 8 (3) is a position where the braking starts in the cradle 13.

In this occasion, when the periphery of the package P is slightly released from the friction roller 12, i.e., the condition illustrated in FIG. 8 (4), the motor 31 is temporarily stopped. In this embodiment, the package P is braked at this temporarily stopped position by a package brake 14*a* installed in the cradle 13 and controlled by a timer until the rotation of the package P is completely stopped.

Then, the cradle 13 is turned again, and the bobbin B with wound package P is released from the bobbin holders 14. More specifically, as the cradle 13 turns, the cam follower 16 disposed at the lower portion of the hinged cradle arm 13*b* abuts with the releasing cam 17 as illustrated in FIG. 9 (5). The hinged cradle arm 13*b* is fully opened between the steps illustrated in FIG. 9 (5) and (6), and the motor 31 is stopped at the position illustrated in FIG. 9 (6), and accordingly, the bobbin B with full package P is disengaged from the bobbin holders 14 and drops onto the bobbin receiver 15, a part of which is attached to the rigid cradle arm 13*a* and the other part of which is attached to the hinged cradle arm 13*b*.

Thereafter, the package P rolls on the packages receiver 83 which is inclined outwardly from the winding portions. The cradle 13 remains stationary while it is opened.

e. Then the empty bobbin donning device is operated. More specifically, the power is transmitted from the small motor 41 through the chain 43 and the empty bobbin arm 51 is swung about the pivot 50 until it it is located at a position corresponding to the bobbin holders 14 of the cradle 13. As described above, the mechanical stop (not shown) is disposed at a position where the empty bobbin arm is stopped, and the springs 44 are installed in the chain 43 so as to damp shock possibly caused by stoppage of the empty bobbin arm 51.

f. Then, the cradle turning motor 31 is rotated in a direction opposite to the previous rotation (FIG. 9 (7) illustrates this condition). FIG. 9 (7) illustrates the condition wherein the bobbin B is chucked by dropping of the cam follower 18 of the releasing cam 17 into the recessed portion of the releasing cam 35 due to the reverse rotation of the motor 31. The motor 31 is rotated in a reverse direction, and the key 82 of the motor spindle 31*a* moves only in the free zone of the gear 32, and accordingly, the movement of the motor 31 is not transmitted to the gear 32. Consequently, the cam 35 integrally secured to the motor spindle 31*a* is rotated.

The motor 31 continues to rotate in a reverse direction, and at a position illustrated in FIG. 10 (8), the engagement between the cam follower 16 disposed on the hinged cradle arm 13*b* and the releasing cam 17 is disengaged, and then the releasing cam 17 is returned by the force of the spring 19 to a position where the releasing cam 17 engages with the eccentric pin 17*b*. Further, during the movement between the positions illustrated in FIGS. 10 (8) and (9), the cradle passes a position for releasing brake.

As the cam 35 rotates, the cam follower 18 of the cradle arm releasing cam 17 enters into the groove of the cam 35. In this instance, the spring force generated by the cradle 13 for holding the bobbin exceeds the force generated by the spring 19 connected to the releasing cam 17, and the bobbin holders 14 chuck an empty bobbin B therebetween.

Then, as the cradle returning motor 31 continues to rotate in a reverse direction, the motor spindle 31*a* and the turning gear 32 lock, in other words, the play mechanism 33 becomes inoperable. Accordingly, the cradle 13 begins to turn in a reverse direction, i.e., in a clockwise direction, and after the package braking mechanism installed in the bobbin holders 14 is released, the empty bobbin B is in contact with the friction roller 12. FIG. 10 (9) illustrates a condition wherein the bobbin B is in contact with the friction roller 12 and wherein the rotational direction of the motor 31 is changed from the reverse direction to the forward direction. The motor 31 is stopped when the key 82 locates in the free zone 10 of the gear 32.

Thereafter, the empty bobbin arm 51 is reversed, i.e., it is rotated in a counter-clockwise direction about the pivot 50, until it chucks a next empty bobbin B on the empty bobbin supply rails 53.

When a requirement for threading is emitted, the whole number of the doffing operations and the threading operations being effected in the winding machine at that time are checked. When the number of the threading operation is less than the predetermined limitation, i.e., the estimated quantity of the compressed air needed for the suction gun is within the capacity of the air supply, the start of the threading operation is permitted, and the threading operation in the working station is performed under the control of the corresponding local control unit c. As described above, the central control unit b controls the times for fully wound packages for all the winding portions. It is possible to avoid such an occurrence wherein the number of the threading operations exceeds the limitation after start of the threading operation, if the time needed for threading operation is estimated and is previously inputted in the central control unit b. After the threading operation, existence of another full wound package is checked.

Figure 5:
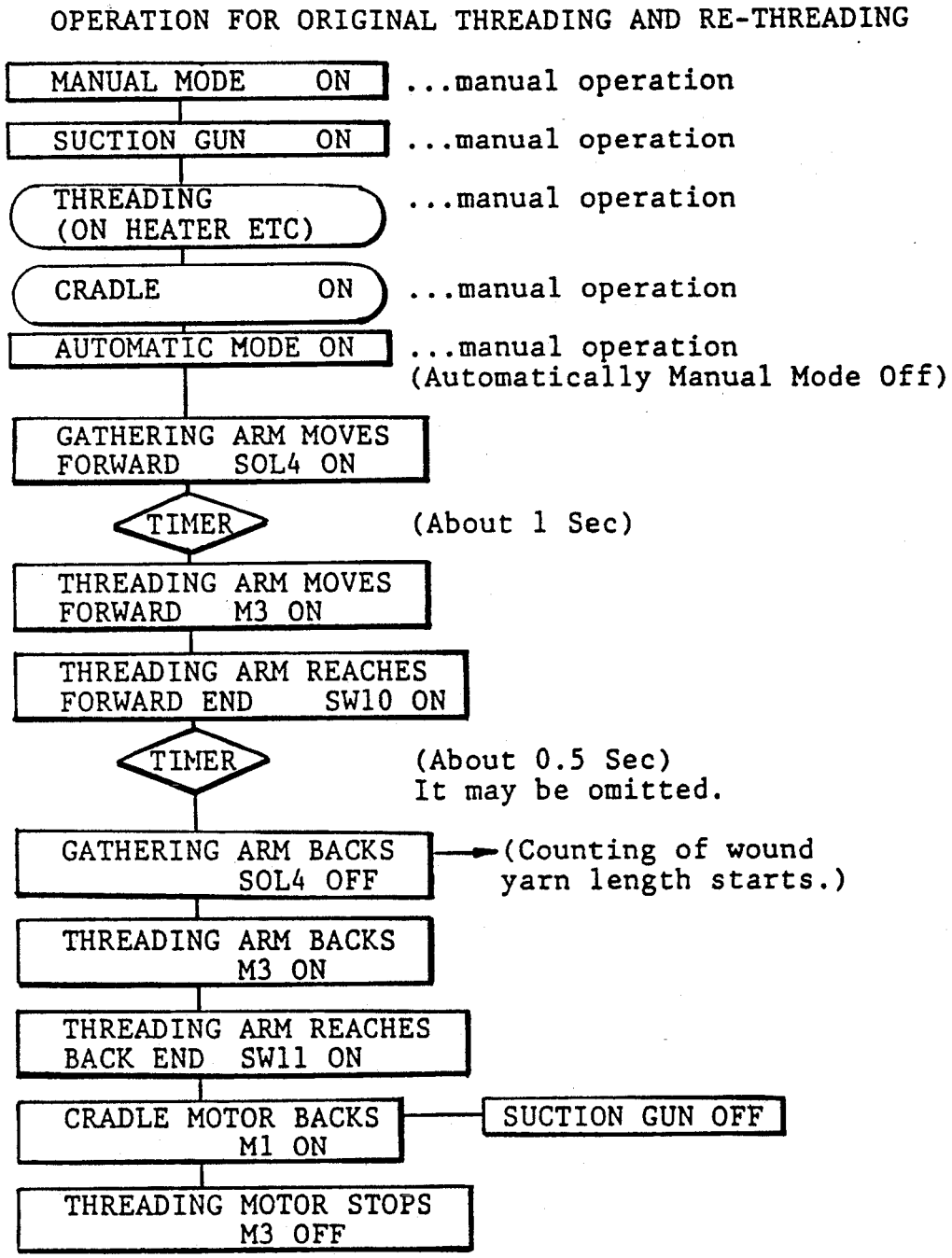
FIG. 5 is a flow chart for original threading and re-threading operation.

Even in case that the threading operation is required, when the number of the threading operation exceeds the predetermined limitation after the whole number of the doffing operations and the threading operations being effected in the winding machine at that time are checked, the central control unit b does not emit a signal for start of threading operation i.e., the signal for start of operation of the suction gun is not emitted. Then the threading operation by the corresponding local control unit c is delayed until the number of the threading operation becomes less than the predetermined limitation, and existence of another full wound package is checked.

g. When a signal for start of threading operation is emitted from the-central control unit b, the suction gun is operated so as to allow an operator to manually thread the yarn to the suction device 21. Thereafter, if a signal for automatic mode "ON" is emitted as illustrated in FIG. 5, the threading of the yarn Y which has been sucked by the suction device 21 onto the rotating bobbin B is performed under the control of the corresponding local control unit c.

First, the yarn gathering arm 61 is swung so that the yarn Y is located at a position where the guide 63*a* disposed at the end of the yarn threading arm 63 can catch the yarn Y, and then the guide 63*a* engages with the yarn Y which has been moved to an appropriate position.

Thereafter, the threading arm 63 is rotated by the threading motor 64, i.e., M3 in FIG. 3, in a substantially vertical plane so that the end of the arm 63 moves in a counter-clockwise direction along an arc passage in a direction perpendicular to the axis of the bobbin B.

As described above, the guide plate (not shown) provided with an inclined groove is securely disposed at a position between the end of the threading arm 63 and the center of the rotation connected to the threading motor 64 so that when the threading arm 63 engages with the inclined groove, the yarn guide 63*a* disposed at the end of the threading arm 63 can be moved in parallel with the axis of the bobbin B. The relationships between the guide plate and the threading arm 63 are so selected that the threading arm 63 engages with the inclined groove just before the yarn Y contacts with the bobbin B.

More specifically, since the threading arm 63 is made of an elastic member, such as a piano wire, its end can move in a direction of the axis of the bobbin B, and accordingly, the yarn Y can surely be positioned at a position corresponding to a slit S formed on the bobbin B even when the position of the slit S may be varied due to the bobbin chucking condition by the bobbin holders 14 or preciseness of the slit S.

Further, when the threading arm 63 is made of an elastic member as described above, the position of the yarn guide 63*a* can be returned to a certain position at the original stage wherein the yarn Y is engaged with the yarn guide 63*a* of the threading arm 63.

Since the yarn guide 63*a* is rotatable, the tension in the yarn Y is prevented from being excessively lowered by the yarn guide 63*a* when the yarn Y is moved by the threading arm 63.

The yarn Y enters into the slit S for holding the yarn Y formed near an end of the bobbin B, and after it is cut at a position between the sucking device 21 and the slit S, it is wound onto the bobbin B.

The yarn may be moved along a straight line along the axis of the bobbin in place of the arc passage.

h. Then the sucking device 21 is switched off, and the yarn gathering arm 61 and the threading arm 63 are returned to their original positions, and thus a series of changing operations are completed.

i. Though the probability is very low, the yarn Y may entangle around the friction roller 12 when the yarn is threaded onto the bobbin B by the threading arm 63. In order to prepare this entanglement, the sensor 70 is disposed as an auxiliary equipment near the friction roller 12 to detect entanglement of the yarn around the friction roller 12. When the sensor 70 is actuated, a yarn cutter (not shown) which is similar to that usually disposed in a usual DTY machine is actuated so as to stop supply of yarn, and the damage caused by entanglement of yarn around the friction roller 12 is prevented. In this case, subsequent operations are manually done in a manner similar to those effected in a usual DTY machine.

(4) Operation when yarn breakage occurs before full package is completed:

a. When the control for winding portions detects a yarn breakage in any winding portion, a signal of occurrence of yarn breakage is emitted to the control means for automatic bobbin changing, and the following steps take place. (See FIG. 5.)

The cradle 13 is turned, and the small package is exhausted onto the package receiver 83.

Then, the empty bobbin arm 51 having an empty bobbin B is turned to a position corresponding to the cradle 13 where the cradle 13 holds the bobbin B, and then, the cradle 13 is turned to a position which is just before the empty bobbin B is in contact with the friction roller 12. Thereafter, the empty bobbin arm 51 returns to its original position to chuck another empty bobbin B.

b. Under the conditions described above, the winding portion waits manual re-threading operation by an operator. Upon manual re-threading operation, the steps illustrated in FIG. 5 take place.

c. Thus the broken yarn is prevented from being in contact with the friction roller 12 and from being rotated therewith for a long time, the surface of such a small package is prevented from being injured.

Figure 6:
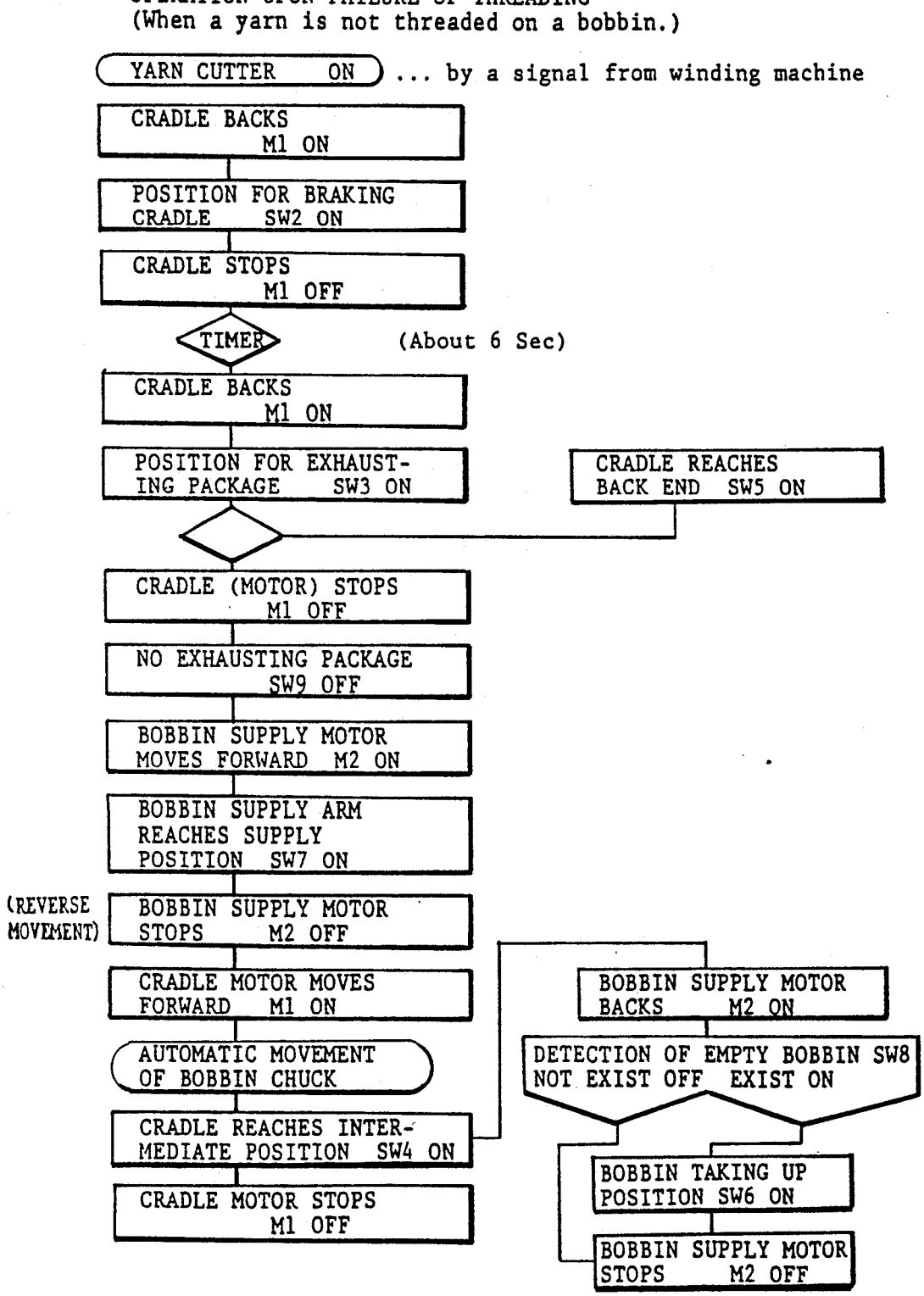
FIG. 6 is a flow chart when threading operation fails.

(5) Operation when the threading by the threading arm fails: (See FIG. 6.)

a. There are two cases, i.e., a case wherein the control for winding portions detects occurrence of yarn breakage, and a case wherein the rotating empty bobbin cannot hold a yarn.

In case that the control for winding portions detects occurrence of yarn breakage, similar to the case described in (3) (i) described above, subsequent operations are manually done in a manner similar to those effected in a usual DTY machine. In case that the rotating empty bobbin cannot hold a yarn, the yarn may be slack when the sucking device 21 is switched off, and then the sensor for detecting a yarn breakage is actuated, and accordingly, the failure will be repaired in a manner similar to that described above. In both cases, a signal that yarn breakage has occurred is transmitted to the control means of the automatic bobbin changing device.

b. In this case, the cradle is operated in a manner similar to that described in (4).

According to the present invention, an automatic bobbin changing apparatus of a winding machine can be installed without using a doffing robot, i.e., without effecting a very large reconstruction or without requiring a lot of costs for reconstruction.

Further, according to the present invention, an automatic bobbin changing apparatus of a winding machine is provided which does not require a large amount of expense for installing accompanying equipment, such as base rails disposed outside the DTY machine or a large space for installing the accompanying equipment and accordingly which can be installed in a conventional plant since a movable type doffer is not used.

The present invention provides an automatic bobbin changing apparatus of a winding machine, for which a control program is not complicated and which does not doff small packages since it doffs only the fully wound packages.

We claim:

1. An automatic bobbin changing apparatus of a winding machine having a plurality of work stations disposed along the lengthwise direction of a machine frame, which comprises:

a yarn treating device, a cradle turning device, an empty bobbin donning device and a package receiver projecting outwardly for guiding fully wound packages which have been doffed from the cradle, which are disposed at a winding portion of each work station of said winding machine:

said yarn treating device including:

a threading motor;

a yarn threading arm connected to said threading motor for engaging a yarn which is sucked to a sucking device and for threading said yarn to a winding bobbin located at the winding portion; and a yarn guide rotatably disposed at an end of said yarn threading arm;

said cradle turning device comprising:

a cradle turning motor;

a drive shaft connected to said cradle turning motor for turning cradles from a winding position to a doffing and donning position across a center of a cradle;

a cradle turning shaft;

a power transmitting device disposed between said drive shaft and said cradle turning shaft and provided with a play mechanism for permitting rotation of said drive shaft without rotation of said cradle turning shaft; and a cam, integrally disposed with said drive shaft, for opening and closing said cradles;

said empty bobbin donning device comprising:

a small motor; and an empty bobbin arm connected to said small motor for being turned from an empty bobbin supply position until it abuts with a mechanical stop; and a control means disposed in said winding machine for operating said yarn treating device, said cradle turning device, said empty bobbin donning device and said package receiver when at least one of the packages at said winding portions reaches a state where it should be changed.

2. An automatic bobbin changing apparatus of a winding machine according to claim 1, wherein said control means comprises:

a central control unit, to which operational conditions for the whole winding machine, such as times for completion of winding, doffing fashion, and the limit for use of suction guns, are inputted and which monitors operational control; and local control units, which are disposed between said central control unit and said work stations, and which exchange information between said central control unit and said work stations and control operation of devices for automatic bobbin changing disposed at said winding portion of each work station, and which transmit signals.

3. An automatic bobbin changing apparatus of a winding machine according to claim 1, which further comprises a sensor for detecting a cradle position disposed after said play mechanism of said power transmitting device.

4. An automatic bobbin changing apparatus of a winding machine according to claim 1, which further comprises a sensor for detecting a portion which is integrally turned with said drive shaft whereby drive of said drive shaft is stopped at an approximately intermediate position of said play mechanism.

5. An automatic bobbin changing apparatus of a winding machine according to claim 1, wherein said threading arm is movable in a direction of an axis of said bobbin.

6. An automatic bobbin changing apparatus of a winding machine according to claim 1, wherein said threading arm is made of an elastic member.

7. An automatic bobbin changing apparatus for a winding machine according to claim 1, wherein said play mechanism of said cradle turning device comprises:

a gear holder secured to said drive shaft and having a first key groove with a key secured thereto;

a first gear engaging said gear holder and having a second key groove therein, the second key groove having a greater size than the first key groove;

a second gear mounted on said cradle turning shaft and engaged by said first gear to drive said cradle turning shaft;

whereby the key of said gear holder engages the second key groove in said first gear such that it is possible to rotate said drive shaft and said gear holder without rotating said first and second gears.

* * * * *

UNITED STATES PATENT AND TRADEMARK OFFICE

CERTIFICATE OF CORRECTION

PATENT NO. : 5,326,039

DATED : July 5, 1994

INVENTOR(S) : Fumio Tanae et al.

It is certified that error appears in the above-identified patent and that said Letters Patent is hereby corrected as shown below:

Col. 1, line 11, "dolling" should be --doffing--.

Col. 1, line 34, "Sot" should be --for--.

Col. 6, line 29, "land" should be --and--.

Col. 9, line 48, "units c" should be --units b--.

Signed and Sealed this

Twentieth Day of September, 1994

Bruce Lehman

*Attest:*

BRUCE LEHMAN

*Attesting Officer*

*Commissioner of Patents and Trademarks*